US011720053B2

(12) United States Patent
Zhou

(10) Patent No.: US 11,720,053 B2
(45) Date of Patent: Aug. 8, 2023

(54) PROCESSING CARTRIDGE FOR AN IMAGING DEVICE

(71) Applicant: ZHUHAI UN-TERN IMAGING PRODUCTS CO., LTD., Guangdong (CN)

(72) Inventor: Honghui Zhou, Guangdong (CN)

(73) Assignee: ZHUHAI UN-TERN IMAGING PRODUCTS CO., LTD., Guangdong (CN)

( * ) Notice: Subject to any disclaimer, the term of this patent is extended or adjusted under 35 U.S.C. 154(b) by 0 days.

(21) Appl. No.: 17/638,205

(22) PCT Filed: Dec. 4, 2019

(86) PCT No.: PCT/CN2019/123060
§ 371 (c)(1),
(2) Date: Feb. 25, 2022

(87) PCT Pub. No.: WO2021/047072
PCT Pub. Date: Mar. 18, 2021

(65) Prior Publication Data

US 2022/0299934 A1 Sep. 22, 2022

(30) Foreign Application Priority Data

Sep. 12, 2019 (CN) ..... 201921530126.4

(51) Int. Cl.
*G03G 21/18* (2006.01)

(52) U.S. Cl.
CPC . *G03G 21/1821* (2013.01); *G03G 2221/1869* (2013.01); *G03G 2221/1884* (2013.01)

(58) Field of Classification Search
CPC ..... G03G 21/1821; G03G 21/1825; G03G 2221/1869; G03G 2221/1884; G03G 2221/1861
See application file for complete search history.

(56) References Cited

U.S. PATENT DOCUMENTS

2007/0160388 A1* 7/2007 Yoshimura ..... G03G 21/1825 399/111
2008/0138107 A1* 6/2008 Mori ..... G03G 21/1825 399/111

(Continued)

FOREIGN PATENT DOCUMENTS

CN 101950149 A 1/2011
CN 103135426 A 6/2013

(Continued)

*Primary Examiner* — Sandra Brase
(74) *Attorney, Agent, or Firm* — Gang Yu

(57) ABSTRACT

Provided is a processing cartridge, which is detachably installed in an imaging device provided with a separation mechanism; the processing cartridge includes: a first unit and a second unit connected with each other in a movable manner; a separating force receiving mechanism, which is arranged at a first end in a length direction of the processing cartridge; an abutment portion, which is located in the second unit; a sliding groove, located at the first end of the processing cartridge; the separating force receiving mechanism includes: a separating force receiving member, movably installed on the sliding groove, including a force receiving portion, a force transmitting portion and a restricting portion; an elastic member having elastic force on the separating force receiving member; under an action of a force of the imaging device, at least a part of the separating force receiving member is able to retract into the processing cartridge.

16 Claims, 6 Drawing Sheets

(56) References Cited

U.S. PATENT DOCUMENTS

| | | | | |
|---|---|---|---|---|
| 2010/0104320 | A1* | 4/2010 | Moon | G03G 15/02 399/176 |
| 2012/0269543 | A1* | 10/2012 | Hashimoto | G03G 21/1853 399/111 |
| 2015/0253723 | A1 | 9/2015 | Morioka et al. | |
| 2019/0146409 | A1 | 5/2019 | Sato | |

FOREIGN PATENT DOCUMENTS

| | | | |
|---|---|---|---|
| CN | 106292236 | A | 1/2017 |
| CN | 108181794 | A | 6/2018 |
| CN | 108398871 | A | 8/2018 |

* cited by examiner

PROCESSING CARTRIDGE FOR AN IMAGING DEVICE

TECHNICAL FIELD

The present disclosure relates to a processing cartridge for an imaging device, and in particular to a processing cartridge with a separating force receiving mechanism.

BACKGROUND

In an imaging device, such as a laser printer, a copier, a fax machine, etc. that uses electrophotographic imaging, there is usually a processing cartridge which can be detached from the imaging device. The processing cartridge known to inventors mainly includes: an integrated processing cartridge that integrates a photosensitive drum unit and a developing unit together, and a separate processing cartridge that only includes a photosensitive drum unit or a developing unit.

In the integrated processing cartridge, the photosensitive drum unit and the developing unit are usually connected to each other by rotatable movement. During the imaging operation, the developing roller is kept pressed toward the photosensitive drum. In a case where the imaging device employs a developing method of placing the developing roller in contact with the photosensitive drum to develop a latent image on the photosensitive drum, the developing roller is kept pressed on an outer peripheral surface of the photosensitive drum. However, during non-imaging operation, if the developing roller keeps in contact with the photosensitive drum surface for a long time, it will bring many adverse consequences, for example, if the developing roller with an elastic layer is used, the elastic layer of the developing roller is in contact with the outer surface of the photosensitive drum, so that the elastic layer of the developing roller may be permanently deformed, and the latent image on the photosensitive drum may be uneven after being used for a long time; if the developing roller is still in contact with the photosensitive drum when no image is formed, no matter whether the developing roller has an elastic layer or not, the developing roller may make the surface of the photosensitive drum attached with redundant developer; in addition, when the developing roller is not used for developing, the photosensitive drum and the developing roller are still in rotationally frictional contact with one another, which is possible to cause premature degradation of the photosensitive drum, the developing roller and the developer.

In order to avoid the above-mentioned problems, the Chinese patent document with the publication number of CN108398871A discloses a processing cartridge. The processing cartridge is internally provided with a separating force receiving mechanism cooperating with a separation mechanism of an imaging device and an abutment portion arranged on a bearing. The separating force receiving mechanism receives a force from a spacing part of the separation mechanism of the imaging device and cooperates with the abutment portion arranged on the bearing of the processing cartridge. When no image is formed, the spacing part of the separation mechanism applies a separating force to the separating force receiving mechanism of the processing cartridge, a force is applied to the abutment portion on the bearing of the processing cartridge through the separating force receiving mechanism, so as to cause relative movement between the photosensitive drum unit and the developing unit, so that the developing roller and the photosensitive drum are separated. However, since the separating force receiving mechanism is located on the front side of the processing cartridge in an installation direction of the processing cartridge and protrudes from an outside of a housing of the processing cartridge, in a process of installing the processing cartridge into the imaging device, the separating force receiving mechanism collides with parts arranged inside the imaging device, the part is such as a guide member in the imaging device, a spacing part of the separation mechanism, etc., inside such an imaging device, so that the separating force receiving member is caused to be damaged to affect a service life of the processing cartridge.

SUMMARY

Some embodiments of the present disclosure provide a processing cartridge that effectively prevents a separating force receiving member from being damaged due to collision with an imaging device during a process of installing the processing cartridge into an imaging device.

In order to solve the above-mentioned technical problem, the technical solution provided by some embodiments of the present disclosure is: a processing cartridge, which is detachably installed in an imaging device, the imaging device being internally provided with a separation mechanism; the processing cartridge includes: a first unit and a second unit connected with each other in a movable manner, the first unit including a first unit frame and a photosensitive drum, the second unit including a second unit frame and a developing roller; a separating force receiving mechanism, arranged at a first end in a length direction of the processing cartridge; an abutment portion, located in the second unit; a sliding groove, which is located at the first end of the processing cartridge; the separating force receiving mechanism includes: a separating force receiving member, movably installed on the sliding groove, including a force receiving portion, a force transmitting portion and a restricting portion, wherein the restricting portion is configured to restrict the separating force receiving member from being separated from the sliding groove in an installation direction of the processing cartridge; an elastic member having elastic force on the separating force receiving member; under an action of a force of the imaging device, at least a part of the separating force receiving member is able to retract into the processing cartridge relative to the sliding groove.

In the processing cartridge with the above-mentioned structure, during a process of installing the processing cartridge into the imaging device, when the separating force receiving mechanism collides with the imaging device, as the separating force receiving mechanism is provided with the elastic member, the separating force receiving member is able to retract into an inside of the processing cartridge relative to the sliding groove, which has a buffering effect to the collision with the imaging device, and prevents the separating force receiving member from being damaged due to strong collision and thus affecting the service life of the processing cartridge. At the same time, the separating force receiving member can move on the sliding groove and cooperate with the abutment portion to effectively separate the developing roller and the photosensitive drum.

In some embodiments, the second unit further includes a gear protection cover, and the abutment portion is arranged on the gear protection cover.

In some embodiments, the sliding groove has an accommodating portion and a first installation portion, and the separating force receiving member is a sliding block correspondingly.

In some embodiments, the sliding block includes a base plate, a first rib plate, a second rib plate, a third rib plate, and fourth rib plate; in the installation direction of the processing cartridge, a clamping groove cooperating with the sliding groove is formed between the first rib plate and the third rib plate, and between the second rib plate and the fourth rib plate; the force transmitting portion is arranged on the base plate; the force receiving portion is arranged on the first rib plate, and the restricting portion is arranged on the third rib plate.

In the above-mentioned processing cartridge, the sliding block and the sliding groove on the processing cartridge cooperate with each other, so that the sliding block can not only slide on the sliding groove, but also retract into the processing cartridge when it collides with the imaging device, so as to buffer the collision with the separation mechanism, thereby avoiding the problem that the separating force receiving member is damaged due to strong collision and thus affects the service life of the processing cartridge.

In some embodiments, in the installation direction of the processing cartridge, a length of the clamping groove is greater than a depth of the sliding groove, so that the sliding block is movable in installation direction of the processing cartridge.

With the processing cartridge with the above-mentioned structure, the sliding block may move in the installation direction of the processing cartridge, which is simple in structure and low in production cost.

In some embodiments, in the length direction of the processing cartridge, a length of the third rib plate is greater than a length of the first installation portion.

According to the above-mentioned processing cartridge, in the length direction of the processing cartridge, the length of the third rib plate is greater than the length of the first installation portion, which can prevent the sliding block from being separated from the sliding groove in the installation direction of the processing cartridge, the structure is simple and the production cost is low.

In some embodiments, the gear protection cover is provided with a second installation portion for installing the elastic member.

In some embodiments, in the installation direction of the processing cartridge, the second installation portion is a gear protection cover surface arranged at a front side of the gear protection cover.

With the processing cartridge with the above-mentioned structure, the elastic member can be stably installed on the processing cartridge, which is simple in structure and low in production cost.

In some embodiments, the elastic member is a compression spring or an elastic sponge.

The above-mentioned processing cartridge uses the compression spring or the elastic sponge as the elastic member, which has good elastic buffering effect, and is simple in structure and low in production cost, and the cooperating effect with the sliding block is good.

In some embodiments, the second installation portion is an installation protrusion arranged on the gear protection cover.

With the processing cartridge with the above-mentioned structure, the elastic member may be stably installed on the processing cartridge, which is simple in structure and low in production cost.

In some embodiments, the elastic member is a torsion spring.

The above-mentioned processing cartridge uses the torsion spring as the elastic member, which has good elastic buffering effect, and is simple in structure and low in production cost, and the cooperating effect with the sliding block is good.

In some embodiments, the sliding block and the elastic member are integrally formed, and the elastic member is an elastic arm of the sliding block.

In the above-mentioned processing cartridge, the sliding block and the elastic member are connected together and form a whole structure, and the structure is simple and the production cost is low.

In some embodiments, the separating force receiving member is movable between a contact position and a spacing position; the developing roller and the photosensitive drum are in contact with each other at the contact position; and at the spacing position, the developing roller and the photosensitive drum are separated from each other.

With the processing cartridge having the above-mentioned structure, the separating force receiving member is movable between the contact position and the spacing position under the action of the separation mechanism of the imaging device, and the separating force receiving member transmits the separating force to the abutment portion, so that the first unit and the second unit move relatively, and the developing roller and the photosensitive drum are effectively separated, thereby protecting the developing roller and increasing the service life of the processing cartridge.

The specific embodiments of the present disclosure will be described in detail below with reference to the accompanying drawings.

DETAILED DESCRIPTION OF THE EMBODIMENTS

Embodiment 1

Figure 4:
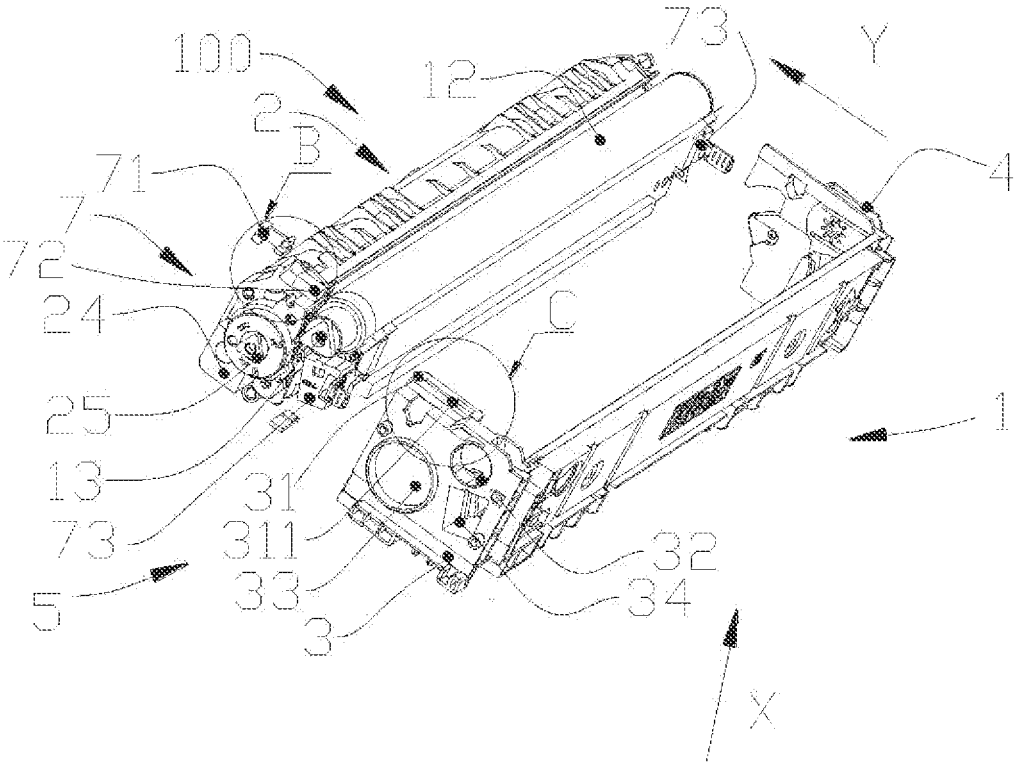
FIG. 4 is a partial exploded view of a processing cartridge of Embodiment 1.
Figure 6:
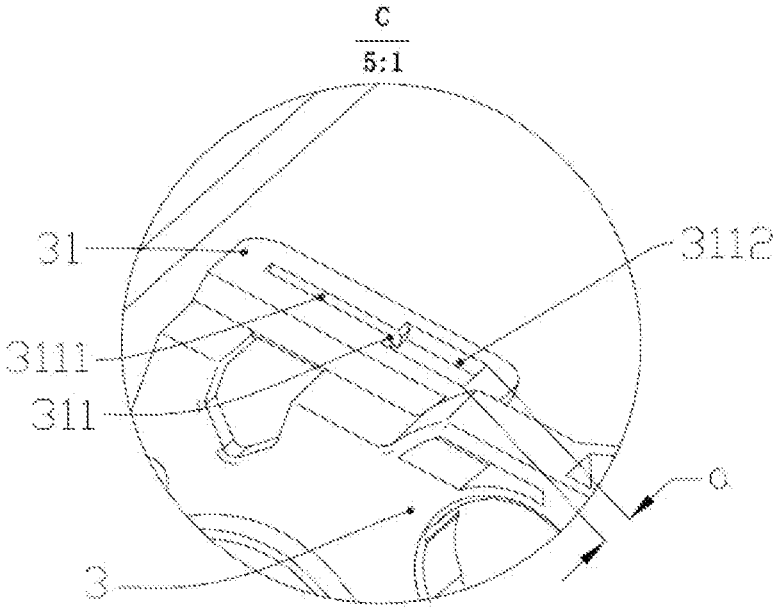
FIG. 6 is a partial enlarged view of C in FIG. 4.

As shown in FIG. 1 to FIG. 3, FIG. 9, and FIG. 10, the processing cartridge 100 includes a first unit 1, a second unit 2, a first end cover 3 and a second end cover 4. In the embodiment, the first unit 1 is a photosensitive drum unit, which may also be referred to as a cleaning unit, and the second unit 2 is a developing unit. The first unit 1 includes a first unit frame 11, a photosensitive drum 12, a charging roller and a waste powder bin (not shown), etc., a surface of the photosensitive drum typically has a photosensitive layer, which may, after exposure, form an electrostatic latent image on the surface thereof. The second unit 2 includes a second unit frame 21, a developing roller 22, a powder feeding roller 26, a layer thickness adjusting device (i.e. doctor blade 27), and a powder bin 23, etc. A developer is accommodated in the powder bin 23, and the powder bin 23 has a powder bin wall (not shown) close to a side of the first end cover 3, the developing roller may send the developer to a surface of the photosensitive drum to perform development processing for the electrostatic latent image formed on the surface of the photosensitive drum. The first unit 1 and the second unit 2 are connected together through a rotatable movement manner. When the processing cartridge 100 is in an initial state that is not subjected to a separating force, the photosensitive drum 12 and the developing roller 22 are in a mutual contact state. When the processing cartridge 100 is subjected to a separating force, the first unit 1 and the second unit 2 may rotatably move relative to each other to separate the photosensitive drum 12 and the developing roller 22. When an external force disappears, under an action of an elastic part 101 in the processing cartridge 100, the first unit 1 and the second unit 2 move rotatably relative to each other again to restore the processing cartridge 100 to the initial state, and the photosensitive drum 12 is in contact with the developing roller 22. That is, by the rotational movement between the second unit 2 and the first unit 1, the developing roller 22 may move between a position where it is in contact with the photosensitive drum 12 and a position where it is spaced apart from the photosensitive drum 12. The first end cover 3 and the second end cover 4 are arranged separately from the first unit frame 11 or may also be integrally formed with the first unit frame 11. In this embodiment, both the first end cover 3 and the second end cover 4 are integrally formed with the first unit frame 11, the first end cover 3 is located at a first end 5 of the processing cartridge 100, and the second end cover 4 is located at a second end 6 in the length direction of the processing cartridge 100, and the first end 5 and the second end 6 are opposite to each other in the length direction of the processing cartridge 100. In the embodiment, the length direction of the processing cartridge 100 is parallel to an axis direction of the developing roller 22. With reference to FIG. 4 and FIG. 6, an extension portion 31 is provided on the first end cover 3, and the extension portion 31 extends in a direction close to the second end cover 6 along the length direction of the processing cartridge 100, a sliding groove 311 is provided on the extension portion 31, and the sliding groove 311 has an accommodating portion 3111 and a first installation portion 3112. Viewing in a direction opposite to the installation direction X of the processing cartridge 100, an outline of the first installation portion 3112 is substantially rectangle, and the first installation portion 3112 has a length of a in the length direction of the processing cartridge 100.

As shown in FIG. 2 to FIG. 5, the first unit 1 further includes a photosensitive drum driving force coupling member 13 (i.e. photosensitive drum driving head), the photosensitive drum driving force coupling member 13 is located at the first end 5 of the processing cartridge 100, an end is connected with the photosensitive drum 12, and the other end extends out from a first through hole 32 of the first end cover 3, and is able to cooperate with a driving member in a main body of the imaging device (not shown) to receive a driving force from the driving member, so as to transmit it to the photosensitive drum 12 and the charging roller to drive a rotating part such as the photosensitive drum 12, the charging roller to rotate. The second unit 2 further includes a gear protection cover 24 and a developing roller driving force coupling member 25. In some embodiments, the gear protection cover 24 and the developing roller driving force coupling member 25 are both located at the first end 5 of the processing cartridge 100. The gear protection cover 24 is located at an inner side of the first end cover 3 and is fixedly connected with the powder bin wall (not shown), and covers a developing roller gear (not shown) and a powder feeding roller gear, etc. The gear protection cover 24 is provided with an abutment portion 241 and a second installation portion 242. In the installation direction X of the processing cartridge 100, the second installation portion 242 of the embodiments is a gear protection cover surface arranged on a front side of the gear protection cover 24, and the abutment portion 241 is also located on the front side of the gear protection cover 24 and is substantially perpendicular to the second installation portion 242. One end of the developing roller driving force coupling member 25 is connected with the developing roller gear and the powder feeding roller gear (not shown), and the other end thereof extends out of a second through hole 33 of the first end cover 3, and the developing roller driving force coupling member 25 is able to cooperate with the driving member in the main body of the imaging device (not shown) to receive the driving force from the driving member, so as to transmit it to the developing roller 22 and the powder feeding roller (not shown) to drive the rotating part such as the developing roller 22, the powder feeding roller (not shown) to rotate.

Figure 7:
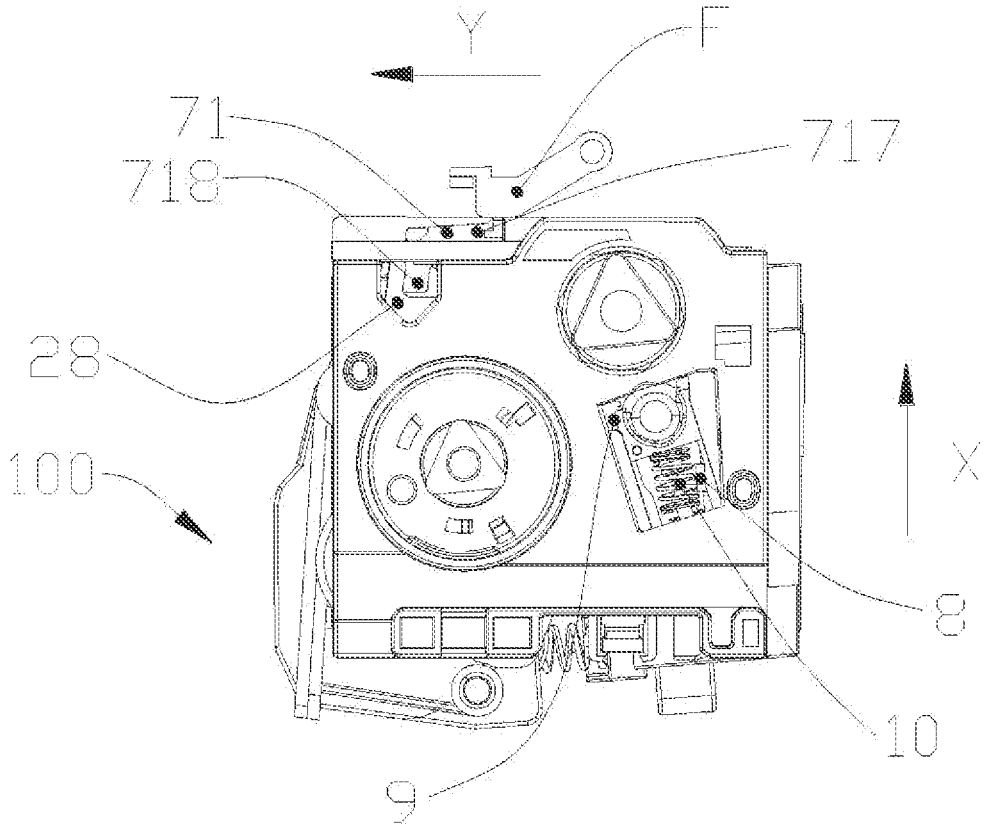
FIG. 7 is a partial schematic structural diagram of a processing cartridge when the sliding block of Embodiment 1 is not subjected to abutting pressure by a separation mechanism of an imaging device in the installation direction of the processing cartridge.

As shown in FIG. 7, in some embodiments of the present disclosure, the processing cartridge further includes a charging roller bracket 9 and a charging roller bracket fixing portion 8, a charging roller bracket installation hole 10 is provided on the first end cover 3, the charging roller bracket fixing portion 8 is exposed through the charging roller bracket installation hole 10. Similarly, a same structure is provided on the second end cover of the processing cartridge.

As shown in FIG. 4 and FIG. 7, in some embodiments of the present disclosure, the processing cartridge further includes an insulating bracket 73, the first end cover 3 is further provided thereon with an insulating bracket installation hole 34, the insulating bracket 73 is connected to the first end cover 3 through the insulating bracket installation hole 34, so that the insulating bracket 73 is conveniently installed onto the first end cover 3, after the insulating bracket 73 is installed, it may play a role in separating the photosensitive drum and the charging roller. The charging roller bracket 9 may be exposed through the insulating bracket installation hole 34, so that the installation of the charging roller may be checked through the insulating bracket installation hole 34.

Figure 9:
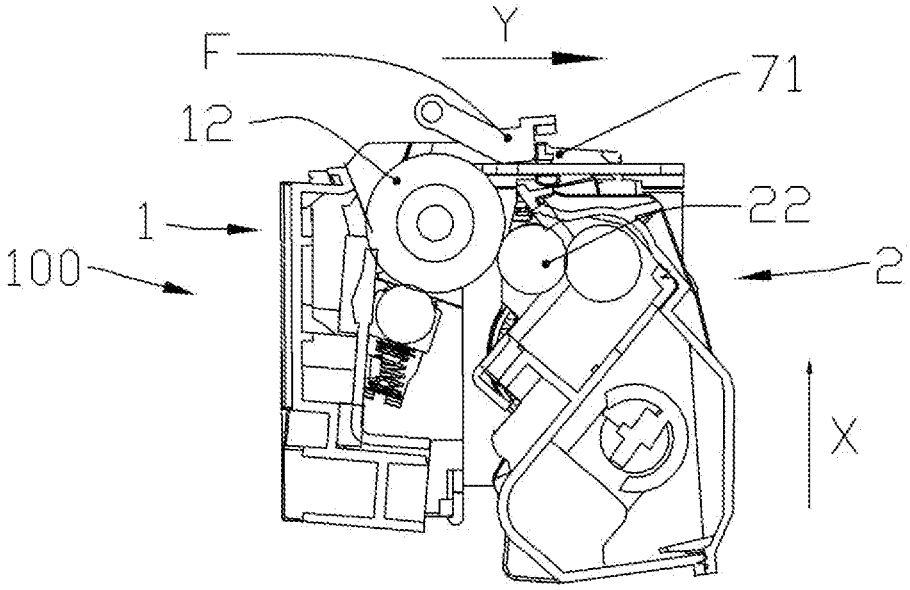
FIG. 9 is a schematic diagram of a position relationship between a sliding block and a separation mechanism of an imaging device when a developing roller and a photosensitive drum of the processing cartridge of Embodiment 1 are in a contact state.

As shown in FIG. 9, in some embodiments of the present disclosure, when the processing cartridge is installing in an electronic imaging device, in a direction of gravity, the photosensitive drum 12 is located at a lower side of the processing cartridge, and an axis of the developing roller 22 is located at an upper side of the axis of the photosensitive drum 12.

Figure 10:
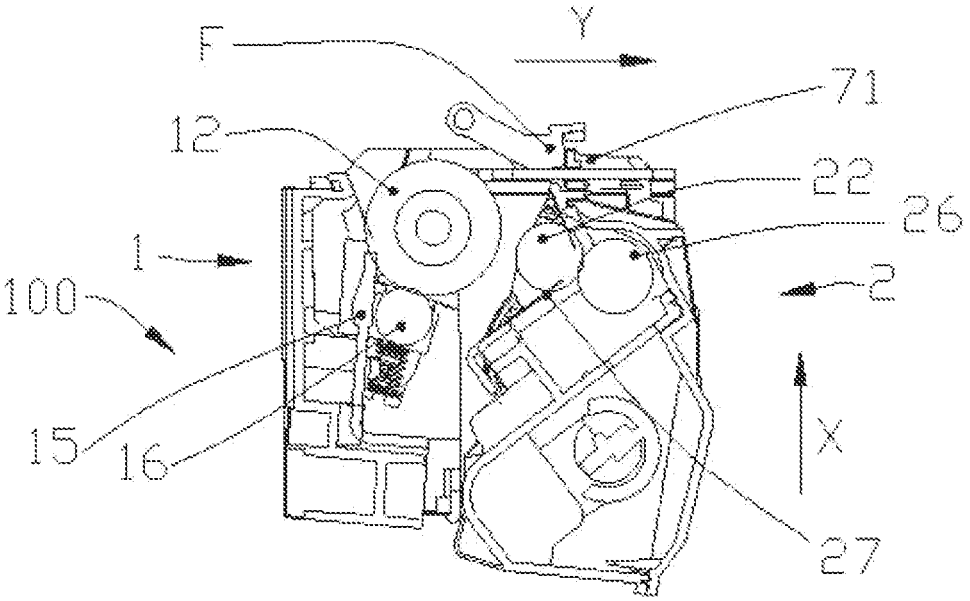
FIG. 10 is a schematic diagram of a position relationship between a sliding block and a separation mechanism of an imaging device when a developing roller and a photosensitive drum of the processing cartridge of Embodiment 1 are in a spacing state.

As shown in FIG. 10, the processing cartridge further includes a cleaning element 15 (i.e. cleaning blade) and a charging roller 16, the cleaning element 15 is connected with the first unit frame 11, the cleaning element 15 is used to clean the developer remained on the photosensitive drum 12. The charging roller 16 is used for charging the photosensitive drum 12.

As shown in FIG. 1 to FIG. 6, the processing cartridge 100 further includes a separating force receiving mechanism 7, and the separating force receiving mechanism 7 includes a separating force receiving member and an elastic member.

Figure 2:
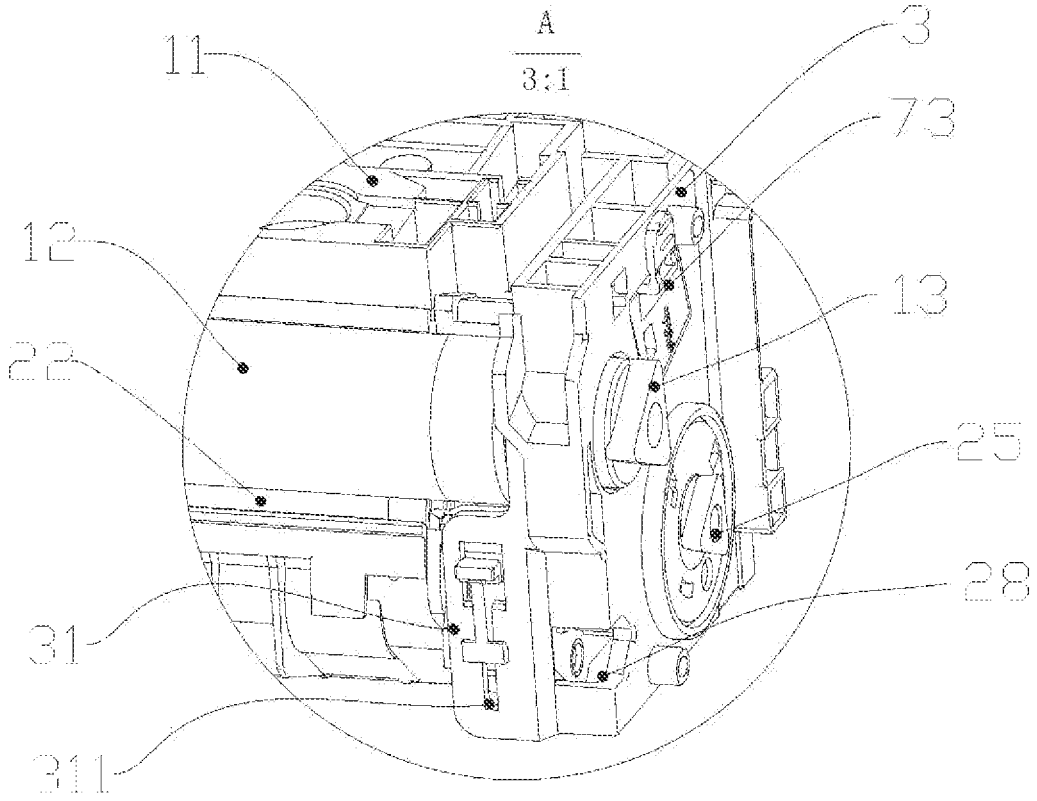
FIG. 2 is a partial enlarged view of A in FIG. 1.
Figure 3:
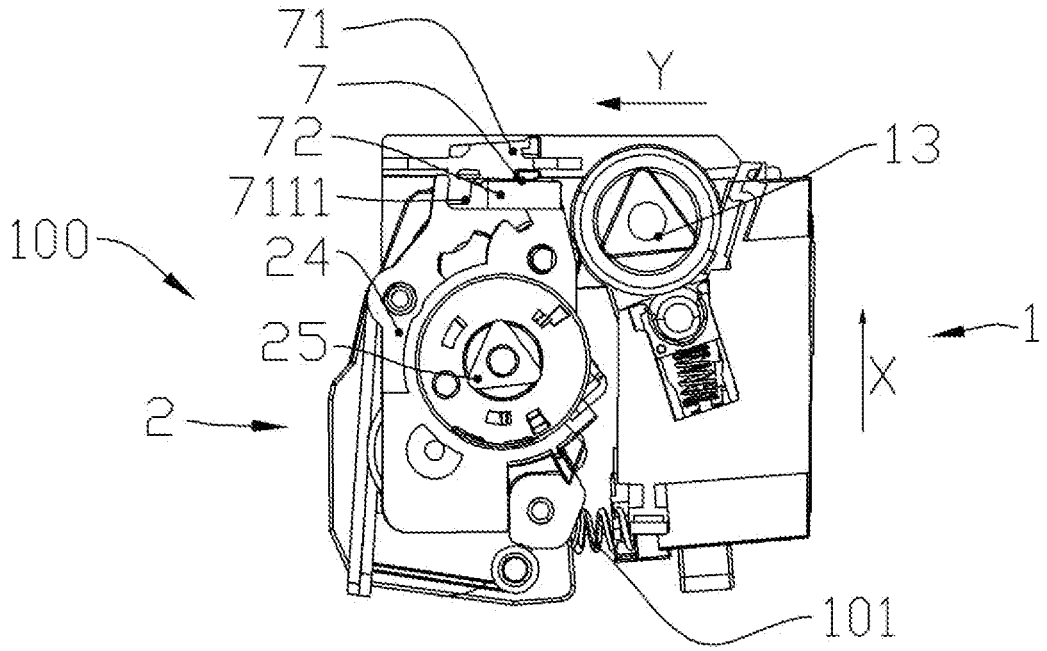
FIG. 3 is a partial schematic structural diagram of a processing cartridge of Embodiment 1.

As shown in FIG. 2, the processing cartridge is provided with a portion-to-be-supported 28, the portion-to-be-supported 28 is arranged, along the direction of gravity, between the separating force receiving member and the photosensitive drum driving force coupling member 13.

Figure 1:
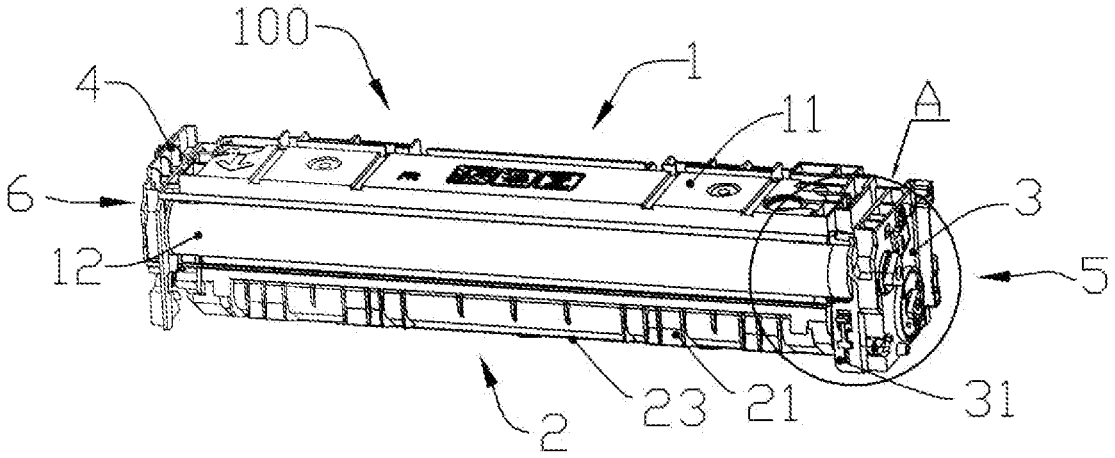
FIG. 1 is a perspective view of a processing cartridge of Embodiment 1.

As shown in FIG. 1 and FIG. 2, in the embodiment of the present invention, the separating force receiving member is a sliding block, under the action of the separating force, the sliding block slides relative to the sliding groove 311 to enable the second unit 2 to rotatably move relative to the first unit 1, so as to bring a powder bin 23 to move relative to the waste powder bin, thereby separating the developing roller and the photosensitive drum.

Figure 5:
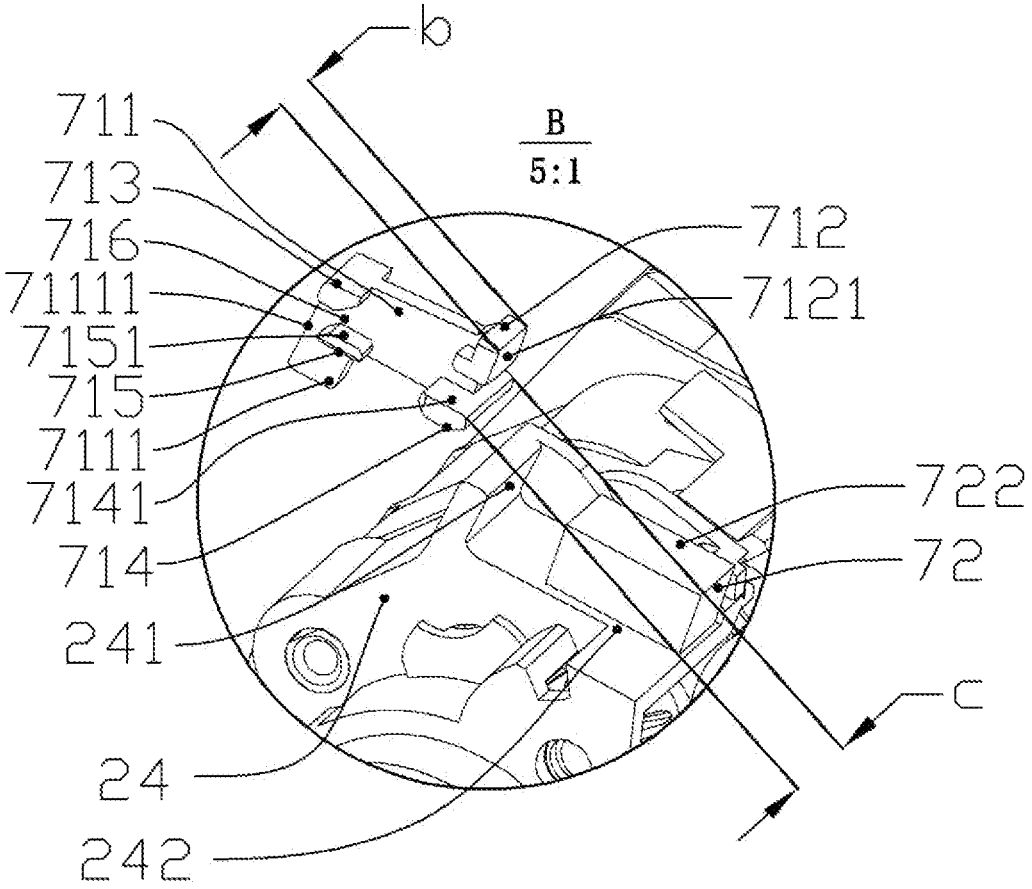
FIG. 5 is a partial enlarged view of B in FIG. 4.
Figure 8:
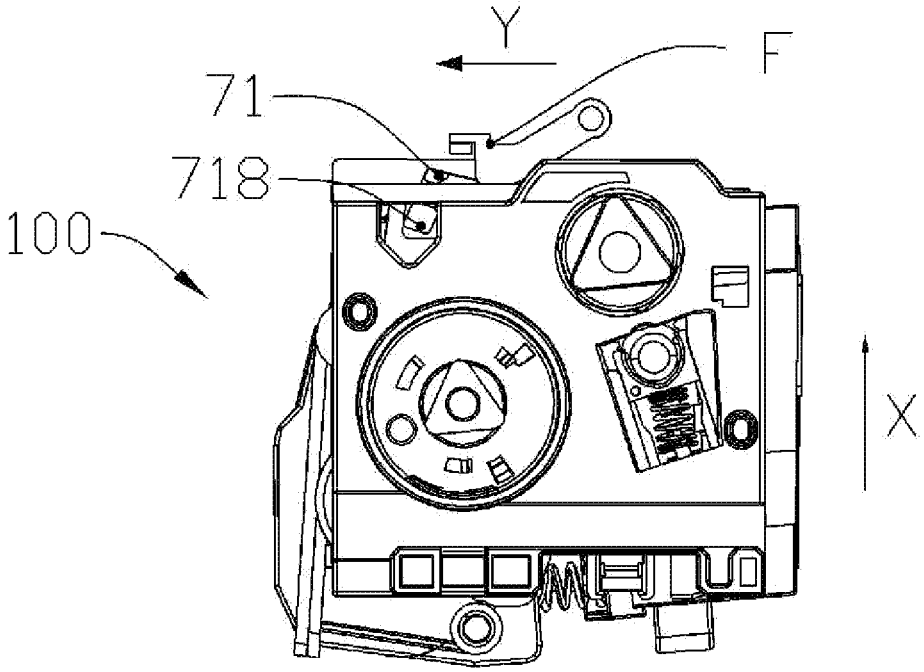
FIG. 8 is a partial schematic structural diagram of a processing cartridge when the sliding block of Embodiment 1 is subjected to abutting pressure by the separation mechanism of the imaging device in the installation direction of the processing cartridge.

In some embodiments, the separating force receiving member is a sliding block 71, and the sliding block 71 is installed on a sliding groove 311 of the first end cover extension portion 31 and cooperates with the sliding groove 311 on the first end cover extension portion 31. In some embodiments, the sliding block 71 basically includes abase plate 711 and a first rib plate 712 which are integrally formed, a second rib plate 713, a third rib plate 714 and a fourth rib plate 715. The base plate 711 is substantially perpendicular to the first rib plate 712, the second rib plate 713, the third rib plate 714 and the fourth rib plate 715 respectively; the base plate 711 is substantially "L-shaped" and the base plate 711 has a force transmitting end 7111. In the installation direction X of the processing cartridge 100, the first rib plate 712 and the second rib plate 713 are located at the front side relative to the third rib plate 714 and the fourth rib plate 715; in the length direction of the processing cartridge 100, the first rib plate 712 has a length b, and the length b of the first rib plate 712 is smaller than a length a of the first installation portion, so as to allow the first rib plate 712 to pass through the first installation portion 3112; in the length direction of the processing cartridge 100, the third rib plate 714 has a length c, and the length c is greater than the length a of the first installation portion, so as to restrict the sliding block 71 from being separated from the sliding groove 311 along the installation direction X of the processing cartridge 100. In some embodiments, in the installation direction X of the processing cartridge 100, the first rib plate 712, the second rib plate 713, the third rib plate 714, and the fourth rib plate 715 all have front and rear side surfaces, the front side surfaces are in front of the installation direction X of the processing cartridge 100, and the opposite sides are the rear side surfaces, and a clamping groove 716 cooperating with the sliding groove 311 is formed respectively between the rear side surface (not shown) of the first rib plate and the front side surface 7141 of the third rib plate, and between the rear side surface (not shown) of the second rib plate and the front side surface 7151 of the fourth rib plate; in the installation direction X of the processing cartridge 100, the clamping groove 716 has a length, which is a distance between the rear side surface (not shown) of the second rib plate and the front side surface 7151 of the fourth rib plate, and correspondingly the sliding groove 311 in the installation direction of the processing cartridge 100 has a depth. The length of the clamping groove 716 is greater than the depth of the sliding groove 311, so as to allow the sliding block 71 to move in the installation direction X of the processing cartridge 100. In some embodiments, the sliding block 71 has a force receiving portion 7121, a force transmitting portion 71111 and a restricting portion. The force receiving portion 7121 is arranged on the first rib plate 712 and is used for receiving the separating force from a separation mechanism of the imaging device; the force transmitting portion 71111 is located on the force transmitting end 7111 of the base plate 711 and faces the abutment portion 241 arranged on the gear protection cover 24, the force transmitting portion 71111 is used for transmitting the separating force to the second unit 2, so that the second unit 2 is rotatably movable relative to the first unit 1; and the restricting portion is arranged on the front side surface 7141 of the third rib plate for restricting the sliding block 71 to be separated from the sliding groove 311 along the installation direction X of the processing cartridge 100. With reference to FIG. 5, FIG. 7 and FIG. 8, the sliding block 71 has a sliding direction Y relative to the sliding groove 311, and in some embodiments, the sliding direction Y is perpendicular to the installation direction X of the processing cartridge 100; in a direction Y in which the sliding block 71 slides relative to the sliding groove 311, the sliding block 71 is divided into a force receiving side 717 and a force transmitting side 718, a side having the force receiving portion 7121 is the force receiving side 717, and a side having the force transmitting portion 71111 is the force transmitting side 718.

The elastic member may be a compression spring or an elastic sponge. In some embodiments, the elastic member is an elastic sponge 72 having a rectangular parallelepiped shape, and the elastic sponge 72 has a first end surface (not shown) and a second end surface 722 in the installation direction X of the processing cartridge 100, and the first end surface (not shown) abuts against the second installation portion 242 arranged on the gear protection cover 24, and the second end surface 722 abuts against the sliding block 71; in the length direction of the processing cartridge 100, the elastic sponge 72 is located between the powder bin wall (not shown) and the first end cover 3, so that the elastic sponge 72 is stably installed on the second installation portion 242 without falling off; in the installation direction X of the processing cartridge 100, the sliding block 71 is located at the front side of the processing cartridge 100. The elastic sponge 72 has an elastic force on the sliding block 71, so that the sliding block protrudes from the sliding groove 311 to an outside of the processing cartridge 100 along the installation direction X of the processing cartridge 100, and may receive the separating force from the separation mechanism of the imaging device; in the installation direction X of the processing cartridge 100, when the sliding block 71 is subjected to an external force, the sliding block 71 is able to overcome the elastic force of the elastic sponge 72 to move towards a direction close to the second installation portion 242, and the sliding block 71 retracts into the processing cartridge 100 relative to the sliding groove 311.

During the process of installing the processing cartridge into the imaging device, the separating force receiving mechanism will collide with elements provided in the imaging device, such as a guide member arranged in the imaging device, a spacing part of the separation mechanism, etc. During the process of installing the processing cartridge into the imaging device, the force borne by the separating force receiving mechanism when colliding with the imaging device may be a force in a direction opposite to the installation direction of the processing cartridge, or a component force in a direction opposite to the installation direction of the processing cartridge; next, a movement process of the separating force receiving mechanism of the processing cartridge will be introduced in detail in a case where the separating force receiving member collides with the spacing part of the separation mechanism in the process of installing the processing cartridge in the imaging device.

As shown in FIG. 3 to FIG. 8, in some embodiments, before the processing cartridge 100 is installed into the imaging device (not shown), the sliding block 71 protrudes to the outside of the processing cartridge 100 relative to the sliding grooves 311 along the installation direction X of the processing cartridge 100 under the action of the elastic force of the elastic sponge 72. The first rib plate 712 and the third rib plate 714 are both located at the first installation portion 3112 of the sliding groove 311, the first rib plate 712 is located outside the processing cartridge 100, and the third rib plate 714 is located inside the processing cartridge 100. During the process of installing the processing cartridge into the imaging device along the installation direction X, when the sliding block 71 of the processing cartridge 100 collides with a spacing part F of the separation mechanism of the imaging device, the force receiving side 717 of the sliding block 71 is pressed against the spacing part F in the direction opposite to the installation direction of the processing cartridge 100, and the force receiving side 717 of the sliding block 71 overcomes the elastic force of the elastic sponge 72 to be retracted inside the processing cartridge 100. As the processing cartridge 100 continues to move and the force receiving side 717 of the sliding block 71 retracts toward inside of the processing cartridge 100, the separating member no longer presses against the sliding block 71, the sliding block 71 springs back to an initial position under the action of the elastic force of the elastic sponge 72.

Next, the process of separating the photosensitive drum and the developing roller when the processing cartridge does not form an image will be described in detail.

In some embodiments, as shown in FIG. 5, FIG. 7 to FIG. 10, when the processing cartridge 100 is in an original state or when an image is formed, the developing roller 22 and the photosensitive drum 12 are in a contact state, and the position where the sliding block 71 is located is a contact position. In some embodiments, when no image is formed, the spacing part F moves in the Y direction, and a separating force is applied to the force receiving portion 7121 to make the sliding block 71 move in the Y direction. The force transmitting portion 71111 of the sliding block 71 abuts against the abutment portion 241 on the gear protection cover 24 to transmit the separating force to the gear protection cover 24, so that the second unit 2 rotatably moves relative to the first unit 1, so as to separate the developing roller 22 and the photosensitive drum 12. In this embodiment, the position where the sliding block 71 is located at the moment is a spacing position. When the spacing part F of the separation mechanism moves in the direction opposite to the Y direction, the separating force borne by the separating force receiving mechanism disappears, the second unit 2 and the first unit 1 are restored to the initial state, and the developing roller 22 is in contact with the photosensitive drum 12.

In some embodiments, when the sliding block 71 collides with the spacing part F of the separation mechanism, the force receiving side 717 of the sliding block 71 retracts into the inside of the processing box 100 relative to the sliding groove 311, and when the sliding block 71 is not pressed against the spacing part F (i.e. when the sliding block 71 does not receive the compression force of the spacing part F) in the installation direction X of the processing cartridge 100, the sliding block 71 springs back to the initial position under the action of the elastic restoring force of the elastic sponge 72. After the installation of the processing cartridge 100 is completed, when no image is formed, under the action of the separating force of the spacing part F, the sliding block 71 cooperates with the abutment portion 241 by the force transmitting portion 71111 to enable the second unit 2 to perform rotational movement relative to the first unit 1 and separate the developing roller 22 and the photosensitive drum 12. Therefore, when the processing cartridge with the separating force receiving mechanism is installed into the imaging device, the collision of the sliding block 71 and the spacing part F of the separating mechanism is effectively buffered, and the interference is reduced, and the sliding block 71 is prevented from being damaged due to strong collision, so that the processing cartridge 100 in the embodiment is longer in service life.

Embodiment 2

Figure 11:
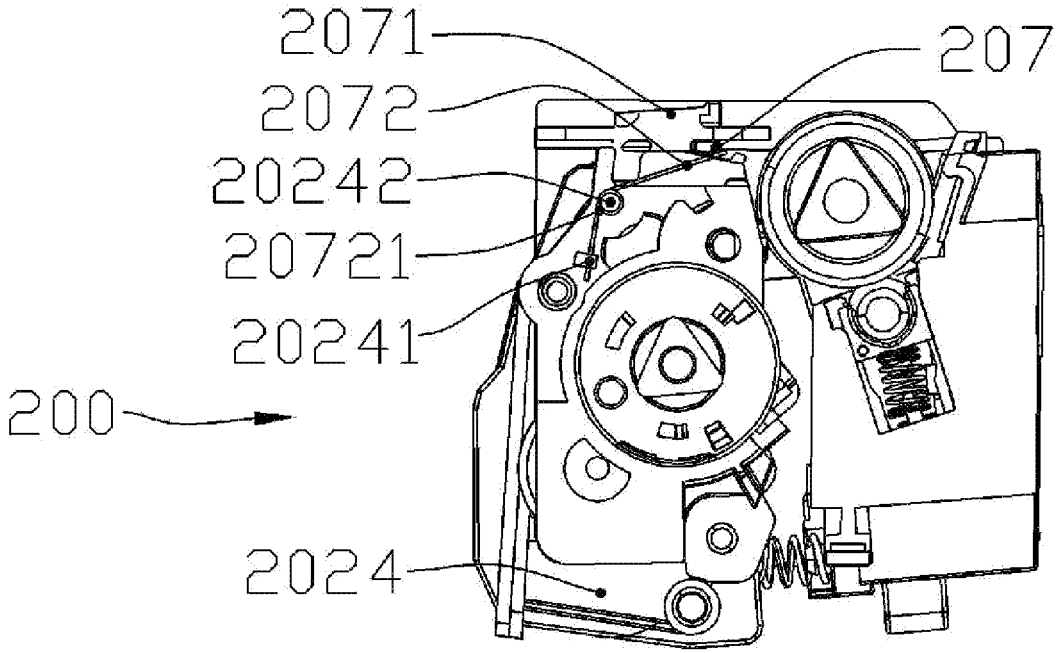
FIG. 11 is a partial schematic structural diagram of a processing cartridge of Embodiment 2.

As shown in FIG. 11, the structure of the processing cartridge 200 of Embodiment 2 is basically the same as that of the processing cartridge 100 of Embodiment 1, except that the elastic member of the separating force receiving mechanism 207 is a torsion spring 2072, the second installation portion is an installation protrusion 20242 arranged on the gear protection cover 2024. The installation protrusion 20242 is located at a side of the gear protection cover 2024 close to the first end cover, the torsion spring 2072 has a connecting portion 20721 and two free ends, the connecting portion 20721 is installed on the installation protrusion 20242, and one free end abuts against a hook portion 20241 on the gear protection cover 2024, the other end abuts against the sliding block 2071, and the torsion spring 2072 has an elastic force to the sliding block 2071.

Embodiment 3

Figure 12:
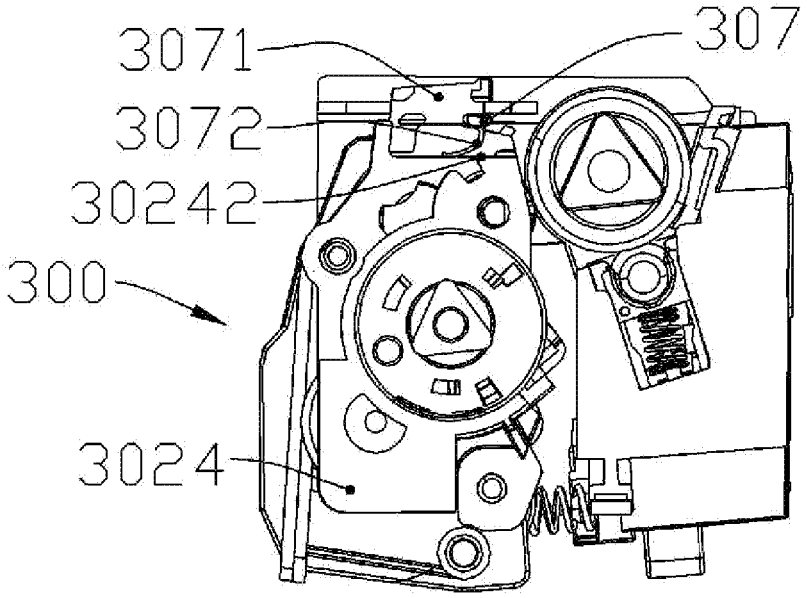
FIG. 12 is a partial schematic structural diagram of a processing cartridge of Embodiment 3.

As shown in FIG. 12, the structure of the processing cartridge 300 of Embodiment 3 is basically the same as that of the processing cartridge 100 of Embodiment 1, except that the structure of the separating force receiving mechanism 307 is different, the sliding block 3071 of Embodiment 3 is and the elastic member are connected together and form a whole structure, the elastic member is an elastic arm 3072 on the sliding block 3071, the elastic arm 3072 is made of an elastic material, and a free end of the elastic arm 3072 abuts against the second installation portion 30242 on the gear protection cover 3024.

The above-mentioned embodiments are only some embodiments of the present disclosure and are not intended to limit the embodiments of the present disclosure. According to the shape, construction and principle of the present disclosure, there are many changes. For example, the elastic member may not be arranged on the gear cover, but on the bearing of the processing cartridge; the abutment portion is not arranged on the gear cover, but is arranged on the bearing, and the like. Therefore, any changes and modifications made without departing from the spirit and scope of the present disclosure should fall within the scope of the present disclosure.

What is claimed is:

1. A processing cartridge for an imaging device, detachably installed to the imaging device, wherein the imaging device is internally provided with a separation mechanism; the processing cartridge comprises:

a first unit and a second unit connected with each other in a movable manner, the first unit comprising a first unit frame and a photosensitive drum, and the second unit comprising a second unit frame and a developing roller;

a separating force receiving mechanism, arranged at a first end in a length direction of the processing cartridge;

an abutment portion, located at the second unit;

a sliding groove, located at the first end of the processing cartridge, wherein the processing cartridge comprises an end cover located at a first end of the processing cartridge, the sliding groove is provided on an extension portion of the end cover, the separating force receiving mechanism comprises:

a separating force receiving member, movably installed on the sliding groove, comprising a force receiving portion, a force transmitting portion and a restricting portion, wherein the restricting portion is configured to restrict the separating force receiving member from being separated from the sliding groove in an installation direction of the processing cartridge;

an elastic member, having an elastic force on the separating force receiving member;

under an action of a force of the imaging device, at least a part of the separating force receiving member is able to retract into the processing cartridge relative to the sliding groove;

the second unit further comprises a gear protection cover, and the abutment portion is arranged on the gear protection cover.

2. The processing cartridge for the imaging device as claimed in claim 1, wherein the sliding groove has an accommodating portion and an installation portion, and correspondingly the separating force receiving member is a sliding block.

3. The processing cartridge for the imaging device as claimed in claim 2, wherein the sliding block comprises a base plate, a first rib plate, a second rib plate, a third rib plate, and fourth rib plate; in the installation direction of the processing cartridge, a clamping groove cooperating with the sliding groove is formed between the first rib plate and the third rib plate, and between the second rib plate and the fourth rib plate; the force transmitting portion is arranged on the base plate; the force receiving portion is arranged on the first rib plate, and the restricting portion is arranged on the third rib plate.

4. The processing cartridge for the imaging device as claimed in claim 3, wherein in the installation direction of the processing cartridge, a length of the clamping groove is greater than a depth of the sliding groove, so that the sliding block is movable in installation direction of the processing cartridge.

5. The processing cartridge for the imaging device as claimed in claim 4, wherein in the length direction of the processing cartridge, a length of the third rib plate is greater than a length of the first installation portion.

6. The processing cartridge for the imaging device as claimed in claim 2, wherein the sliding block and the elastic member are integrally formed, and the elastic member is an elastic arm of the sliding block.

7. The processing cartridge for the imaging device as claimed in claim 1, wherein the gear protection cover is provided with an installation portion for installing the elastic member.

8. The processing cartridge for the imaging device as claimed in claim 7, wherein in the installation direction of the processing cartridge, the installation portion is a gear protection cover surface arranged at a front side of the gear protection cover.

9. The processing cartridge for the imaging device as claimed in claim 7, wherein the installation portion is an installation protrusion arranged on the gear protection cover.

10. The processing cartridge for the imaging device as claimed in claim 9, wherein the elastic member is a torsion spring.

11. The processing cartridge for the imaging device as claimed in claim 1, wherein the elastic member is a compression spring or an elastic sponge.

12. The processing cartridge for the imaging device as claimed in claim 1, wherein the separating force receiving member is movable between a contact position and a spacing position; the developing roller is in contact with the photosensitive drum in the contact position; and in the spacing position, the developing roller and the photosensitive drum are separated from each other.

13. The processing cartridge for the imaging device as claimed in claim 1, wherein the separating force receiving member is a sliding block, under an action of a separating force, the sliding block slides relative to the sliding groove, and abuts against the abutment portion to enable the second unit to rotatably move relative to the first unit, so that the developing roller and the photosensitive drum are separated.

14. The processing cartridge for the imaging device as claimed in claim 1, wherein the end cover being provided thereon with a first through hole and a second through hole, the end cover and the first unit frame being integrally formed, the first unit further comprises a photosensitive drum driving force coupling member, an end of the photosensitive drum driving force coupling member being connected with the photosensitive drum, an other end extending out from the first through hole; the second unit further comprises a developing roller driving force coupling member, an end of the developing roller driving force coupling member being connected with a developing roller gear, an other end extending out from the second through hole.

15. The processing cartridge for the imaging device as claimed in claim 14, wherein the processing cartridge further comprises a charging roller bracket and a bracket fixing portion, a charging roller bracket installation hole being provided on the end cover, the bracket fixing portion is exposed through the charging roller bracket installation hole.

16. The processing cartridge for the imaging device as claimed in claim 15, wherein the processing cartridge further comprises an insulating bracket, wherein the end cover is further provided thereon with an insulating bracket installation hole, the insulating bracket is connected with the end cover through the insulating bracket installation hole, and the charging roller bracket is exposed through the insulating bracket installation hole.

* * * * *